US010096905B2

(12) United States Patent
Cross et al.

(10) Patent No.: US 10,096,905 B2
(45) **Date of Patent: *Oct. 9, 2018**

(54) FREQUENCY SELECTIVE SURFACES

(71) Applicants: Lee W. Cross, Chesterbrook, PA (US); Carol Ann Wedding, Toledo, OH (US); Daniel K. Wedding, Toledo, OH (US); Edwin F. Peters, Toledo, OH (US)

(72) Inventors: Lee W. Cross, Chesterbrook, PA (US); Carol Ann Wedding, Toledo, OH (US); Daniel K. Wedding, Toledo, OH (US); Edwin F. Peters, Toledo, OH (US)

(73) Assignee: Imaging Systems Technology, Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/383,215

(22) Filed: Dec. 19, 2016

(65) Prior Publication Data

US 2017/0098893 A1 Apr. 6, 2017

Related U.S. Application Data

(63) Continuation of application No. 14/955,464, filed on Dec. 1, 2015, now Pat. No. 9,559,426, which is a continuation-in-part of application No. 14/260,265, filed on Apr. 23, 2014.

(60) Provisional application No. 61/814,924, filed on Apr. 23, 2014.

(51) Int. Cl.
*H01Q 15/00* (2006.01)
*H01J 11/20* (2012.01)

(52) U.S. Cl.
CPC ..... *H01Q 15/002* (2013.01); *H01J 11/20* (2013.01)

(58) Field of Classification Search
None
See application file for complete search history.

(56) References Cited

U.S. PATENT DOCUMENTS 6,538,596 B1 * 3/2003 Gilbert ..... F41H 3/00 342/1
7,015,878 B1 * 3/2006 Doyen ..... G09G 3/2029 315/169.3
7,456,571 B1 * 11/2008 Wedding ..... H01J 11/18 313/582
7,863,815 B1 * 1/2011 Wedding ..... H01J 11/18 313/582
8,138,673 B1 * 3/2012 Wedding ..... H01J 47/02 313/567
8,471,470 B1 * 6/2013 Wedding ..... H01J 47/02 313/567
8,508,447 B2 * 8/2013 Pyayt ..... G09G 3/36 345/108
8,816,798 B2 * 8/2014 McKinzie, III ..... H01P 1/16 333/175
2005/0280372 A1 * 12/2005 Anderson ..... H01Q 1/366 315/111.21

(Continued)

*Primary Examiner* — Ashok Patel
(74) *Attorney, Agent, or Firm* — Donald K. Wedding

(57) ABSTRACT

A switchable Frequency Selective Surface (FSS) in which the switchable elements are Plasma-shells. Plasma-shells as described herein allow for control or 'reconfiguration' of the FSS electromagnetic (EM) properties.

4 Claims, 4 Drawing Sheets

(56) References Cited

U.S. PATENT DOCUMENTS

2009/0134803 A1* 5/2009 Anderson ..... H05H 1/46
315/111.21

* cited by examiner

FREQUENCY SELECTIVE SURFACES

RELATED APPLICATIONS

This application is a continuation under 35 U.S.C. 120 from copending U.S. patent application Ser. No. 14/955,464 filed Dec. 1, 2015 which is a continuation-in-part under 35 U.S.C. 120 from U.S. patent application Ser. No. 14/260,265 filed Apr. 23, 2014, now abandoned, which claims priority under 35 U.S.C. 119(e) from Provisional U.S. Patent Application Ser. No. 61/814,924 filed Apr. 23, 2013, all incorporated herein by reference.

SUMMARY OF INVENTION

This invention discloses an improved switchable Frequency Selective Surface (FSS) in which the switchable elements are Plasma-shells. Plasma-shells as described herein allow for control or 'reconfiguration' of the FSS frequency response.

The FSS can reflect, transmit, or absorb different amounts of propagating electromagnetic (EM) energy at different frequencies, polarizations, and wave directions. FSS is often used in radomes to reject out-of-band signals and reduce radar cross section. Radar cross section is the measure of how detectable an object is to radar. FSS EM properties are fixed unless switching elements are included. When energized, the Plasma-shells shunt elements to ground forming a conductive sheet. This blocks microwave transmission and the plasma-actuated conductive sheet protects sensitive electronics from electromagnetic pulses (EMP). In addition to the unique switching capability, the plasma-switched (PS) FSS is strong, rugged, lightweight, conformable, and easily retrofitted to any surface. Plasma-shells may be actuated by control electronics connected to the shell or may be actuated by high-power EM energy incident to the surface. The dimensions of the contained plasma are irrelevant to the performance of the FSS.

PRIOR ART

Plasma FSSs are known in the prior art. A primary failing of the prior art is that it makes use of plasma encapsulated in elongated gas tubes or large-area glass plates. The invention herein discloses a Frequency Selective Surface (FSS) using small, discrete Plasma-shells. Because of their small size they can be incorporated into EM structures resulting in low-profile systems only a few centimeters thick. Other differences between the invention disclosed herein and the prior art include, not by way of limitation, plasma-based FSS elements formed by a combination of conductive and non-conductive FSS patterning combined with a Plasma-shell.

The concept of using plasma as a microwave absorber or reflector has existed for decades as in H. Shapiro, "Electromagnetic scattering properties," Ph.D. dissertation, California Inst. of Techn., Pasadena, Calif., January 1956 and H. M. Musal, "On the theory of the radar-plasma absorption effect, " GM Defense Res. Laboratories, Santa Barbara, Calif., July 1963, however, few devices have been experimentally demonstrated. Such devices primarily consist of long, fragile plasma tubes. Anderson et al. presented devices using cylindrical mercury lamps as switchable plasma volumes, sharing all the problems of mercury lamps: fragility, limited life, modulation speed limited to kilohertz (kHz), and toxic mercury vapor seen in T. Anderson et al., "Plasma frequency selective surfaces," *IEEE Plasma Sci.*, vol. 35, no. 2, April 2007. In J. C. Vardaxoglou, "Optical switching of frequency selective surface bandpass response," *IEEE Electronics Lett., vol.* 32, no. 25, pp. 2345-2346, December 1996, Vardaxoglou demonstrated a solid-state switchable plasma device by illuminating a patterned semiconductor wafer, but is likewise fragile, size limited, and very restricted in available material properties and thicknesses. Murphy et al. introduced a large-area plasma sheet reflector that operated by a pulsed electron beam and exhibited low levels of RF interaction seen in D. P. Murphy et al., "X-band microwave properties of a rectangular plasma sheet," Interim Rep., Naval Res. Lab, Washington, D.C., May 1999. Larigaldie and Caillault showed significant X-band sheet reflection but only in pulsed mode with magnetic confinement in S. Larigaldie and L. Caillault, "Dynamics of a helium plasma sheet created by a hollow-cathode electron beam," *J. Appl. Phys.*, vol. 33, pp. 3190-3197, July 2000. Scharer et al. demonstrated large-volume plasma and RF reflection from ultraviolet (UV) photoionization of an organic seed gas using a pulsed laser in Y. S. Zhang and J. E. Scharer, "Plasma generation in an organic molecular gas by an ultraviolet laser pulse," *J. Appl. Phys.*, vol 73, no. 10, pp. 4779-4784, January 1993 and K. L. Kelly et al., "Laser ionization and radio frequency sustainment of high-pressure seeded plasmas," *J. Appl. Phys., vol.* 92, no. 2, pp. 700-709, July 2002.

T. J. Pavliscak et al. disclosed the use of discrete encapsulated plasma elements for use in reflective applications, however, transmission of free-space EM energy is not possible with these structures U.S. Pat. No. 7,719,471 (Pavliscak et al.) and U.S. Pat. No. 7,999,747 (Pavliscak et al.). Plasma FSS structures have been disclosed for the purpose of antenna miniaturization through enhanced matching, however the plasma structure acts as a transmit/receive antenna and does not couple FSS elements with encapsulated plasma elements U.S. Pat. No. 7,292,191 (Anderson) and U.S. Pat. No. 7,453,403 (Anderson). Plasma FSS structures have also been disclosed for use as steerable antennas that assume that the plasma geometry forms FSS elements and implies that biasing is accomplished separately from the FSS layer, whereas the structure disclosed here in: (a) is not an antenna or a beam steering device; (b) contains discrete plasma elements; (c) biasing of plasma elements is accomplished using the FSS structure itself; and (d) can be implemented with as few as one layer U.S. Pat. No. 6,870,517 (Anderson) and U.S. Pat. No. 7,342,549 (Anderson).

DETAILED DESCRIPTION OF THE DRAWINGS

Figure 1:
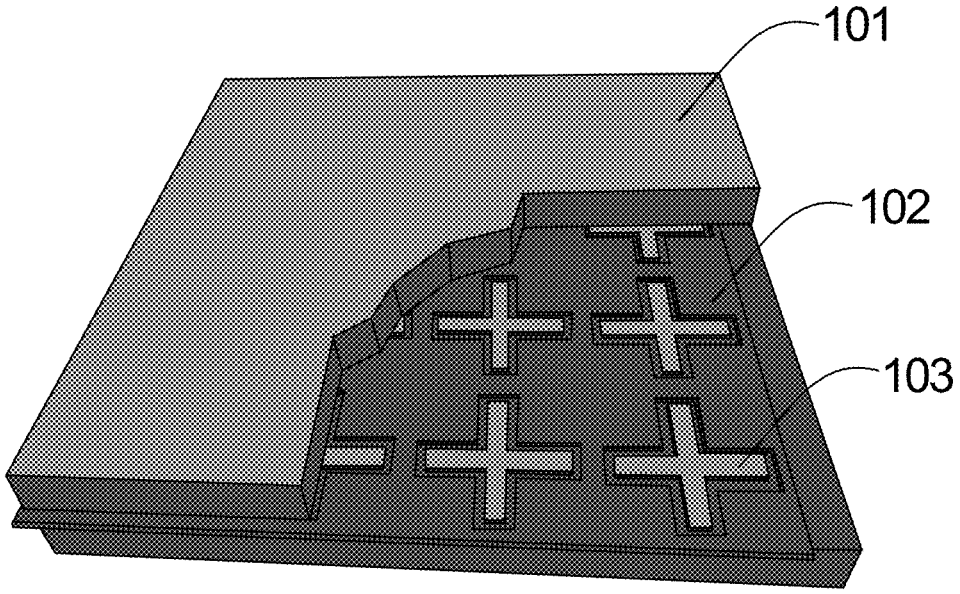
FIG. 1 shows a typical two-dimensional composite Frequency Selective Surface (FSS).

FIG. 1 shows a typical two-dimensional Frequency Selective Surface (FSS). Conductive Layer 102 is applied to dielectric substrate 101. Four legged loaded elements 103 are patterned into the conductive layer.

Figure 2A:
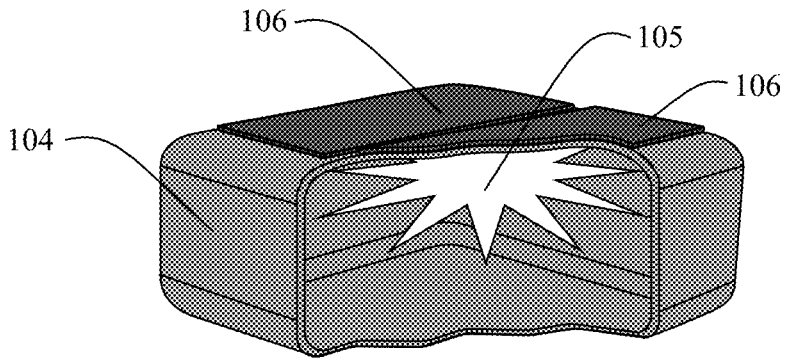
FIG. 2A is a physical diagram of a sectioned Plasma-shell with internal plasma.

FIG. 2A is a physical diagram of a Plasma-shell 104. Plasma-shells consist of a hollow, impervious dielectric shell of any shape 104 that encapsulates a pressurized gas that can be ionized into conductive plasma 105 independently from the FSS layer. Optional electrodes 106 are shown on the top surface. A differential voltage between electrodes energizes neutral gas molecules into plasma through the process of ionization. Plasma-shells can be produced from a variety of materials including glasses and ceramics. Plasma-shells or shells may be fabricated with multiple material layers to customize shell properties for specific applications. Any shape is possible including cubes and right circular cylinders. Finished external dimensions range from about 0.5 mm to about 10 mm. Plasma-shells are filled with a variety of gases with controlled pressures from about 5 to about 500 Torr. Conductive electrodes of any configuration can be applied to shell surfaces. Large Plasma-shell arrays can be assembled on substrates or conductive layers. In the normal un-energized Plasma-shell condition, the shell material and gas are non-conductive and transparent to RF energy.

Figure 2B:
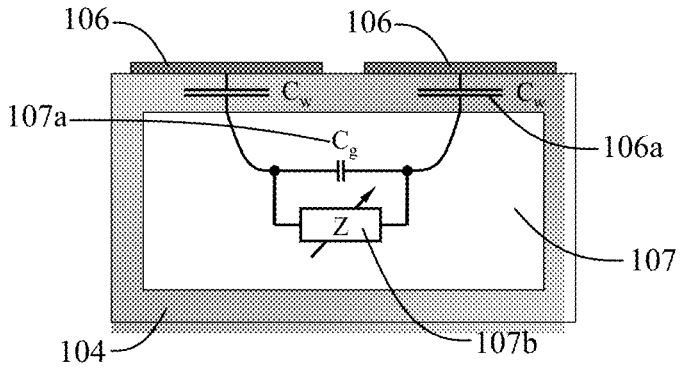
FIG. 2B shows an equivalent electrical circuit model of a single Plasma-shell used as a microwave tunable element.

FIG. 2B shows an equivalent electrical circuit model for a single Plasma-shell, or shell, used as a tunable microwave element. Conductive electrodes 106 are patterned on the top of the shell 104 to apply an electric (E)-field of sufficient intensity to excite the interior gas 107 into plasma. The shell walls have significant wall capacitance, $C_w$ 106*a*, in series with a very small capacitance across the gas, $C_g$ 107*a*. Gas impedance, Z 107*b*, changes dramatically with the degree of plasma ionization and allows the Plasma-shell to be used as a tunable element.

Figure 3:
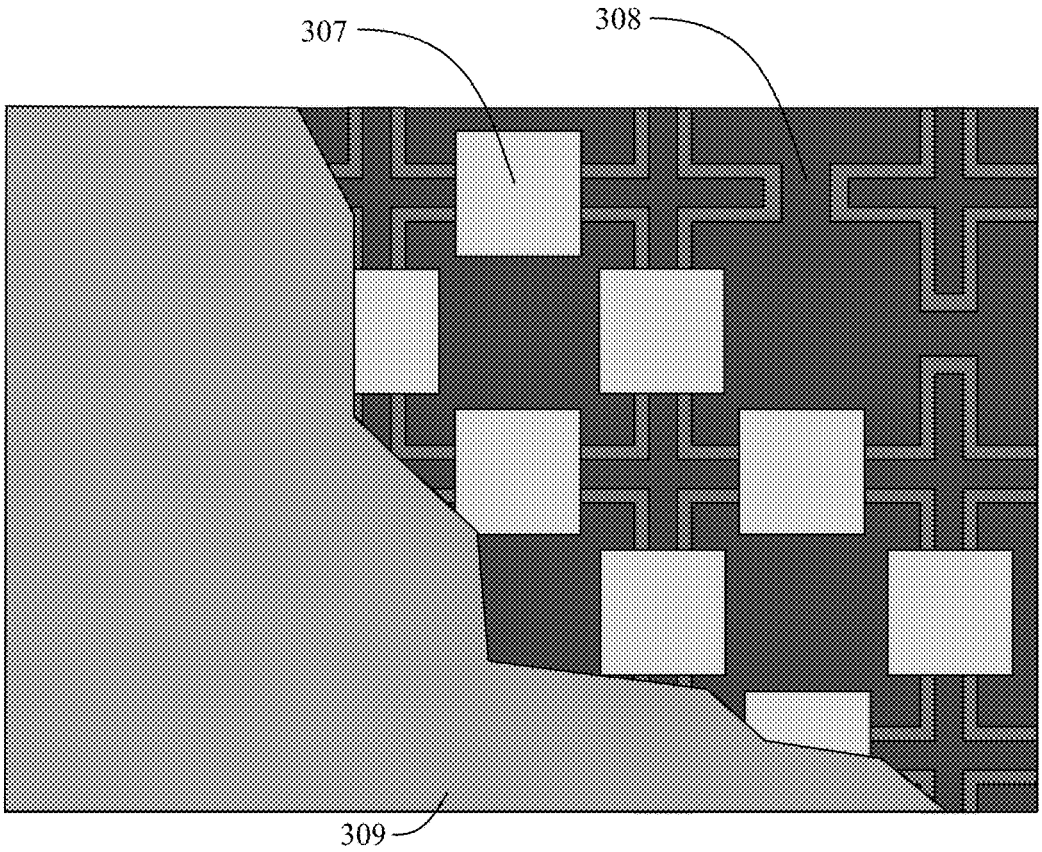
FIG. 3 is an FSS with Plasma-shells consistent with this invention.

FIG. 3 is an FSS device with Plasma-shells 307. Plasma-shells 307 connect the cross-shaped four-legged loaded elements 308 covered with a non-conductive layer 309. When energized, the Plasma-shells shunt elements to ground forming a conductive sheet. This blocks microwave transmission, and the plasma-actuated conductive sheet can protect sensitive electronics from electromagnetic pulses (EMP). In addition to the unique switching capability, the plasma-switched (PS) FSS is strong, rugged, lightweight, conformable, and easily retrofitted to any surface. Plasma-shells may be actuated by control electronics connected to the shell or may be actuated by high-power EM energy incident to the surface. The dimensions of the contained plasma are irrelevant to the performance of the FSS.

RF/Microwave Plasma-Shell Frequency Selective Surfaces

FSSs are EM structures that interact with EM energy propagating in free space. The microwave frequency range, loosely defined as 0.3-30 gigahertz (GHz), is used for applications including radar, communication, instrumentation, and power transfer. An FSS is a periodic surface with a RF response that varies with frequency. A frequency selective surface layer is composed of arrays of elements that can be of any shape including, but not limited to, dipoles, circular dipoles, helicals, circular or square or other spirals, biconicals, hexagons, tripods, Jerusalem crosses, plus-sign crosses, annular rings, gang buster type antennas, tripole elements, anchor elements, star or spoked elements, alpha elements, gamma elements, MK elements, and/or combinations thereof. FSS layers can be implemented as conductive patterns or non-conductive regions on otherwise conductive sheets. One or more elements are composed into a unit cell that serves as a template that is regularly applied over a flat or curved conformal surface. The geometry of the unit cell may be varied over the FSS layer surface to accommodate features such as edge treatment, tapering of EM properties, close packing, or to optimize other performance properties. FSS layers may be applied to substrates or remain free standing. Common microwave FSS applications include hybrid radomes, spatial band-pass or band-stop filters, dichroic reflectors and subreflectors, absorbers, and polarizers.

Plasma components may be integrated with FSS structures to create a plasma FSS device with desirable properties such as direct EM energy-plasma interaction, high-power limiting to limit power density allowed to transmit through the device, and controllable frequency response (e.g., controllable operating frequency and/or transmission/absorption/reflection properties). The plasma FSS improves the conventional FSS design by modifying the unit cell to include FSS elements in combination with plasma, resulting in plasma-controlled EM properties.

Plasma-shells are gas encapsulating structures that hermetically contain a single gas or gas mixture at controlled pressure independently of the FSS layer. When used as switchable plasma elements, the inner wall is resistant to direct contact with plasma. Plasma-shells are switchable plasma elements because the degree of internal gas ionization can be controlled by application of electrical or RF energy.

The energy required to create and sustain plasma can be supplied externally by high-power incident RF energy, or from a high-voltage power supply connected to conductive elements that are part of the plasma FSS structure. The FSS structure can be used to distribute energy from the power supply to Plasma-shells. Using a power supply to provide Plasma-shell drive voltage is also called biasing.

Disclosed herein is a device to create a large-area plasma-controlled surface that interacts with propagating EM energy. Electrical energy is required for creating and sustaining the FSS device and is provided by an external voltage source or the incident RF wave, and RF-plasma interaction may occur over the entire microwave frequency range with EM energy of any polarization and any power level.

In this invention, a Plasma-shell is sandwiched between two conductor sheets, with the conductor sheets being patterned so as to be transparent to a particular band of radio frequencies (RF).

Figure 4A:
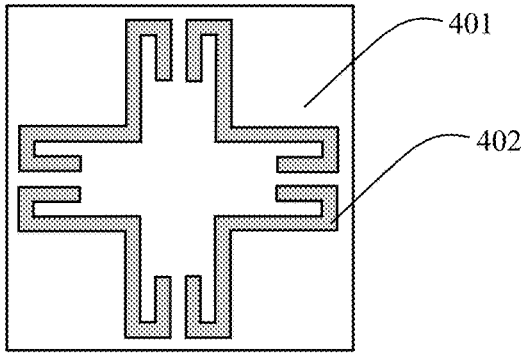
FIG. 4A is a single FSS unit cell.

FIG. 4A shows a single FSS unit cell composed of four etched 402 slots in a conductive sheet 401. The element pattern, called an MK element, is one pattern of many that has the properties of band-pass characteristic, free-standing (does not have unconnected "floating" elements), and large conductor area coverage. This structure is beneficial for an extremely lightweight structure that effectively produces a volume of plasma within an array of Plasma-shells.

The FSS element pattern is repeated on the conductive sheet on a closely-spaced regular grid. The conductive sheets may be fabricated as a single etched or electroformed metal sheet or a single-sided printed circuit board (PCB). At X-band frequencies (8-12 GHz), the FSS element is slightly larger than a typical Plasma-shell.

Figure 4B:
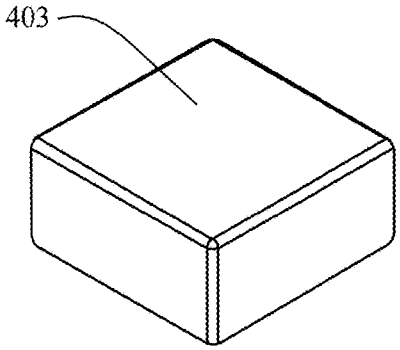
FIG. 4B is a single Plasma-shell.

FIG. 4B is a single, hollow ceramic Plasma-shell 403, a hermetically sealed and filled with any gas.

Figure 4C:
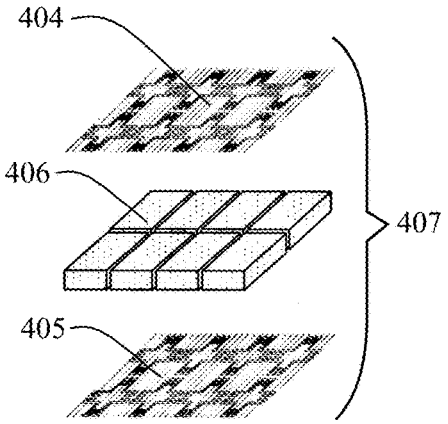
FIG. 4C is an exploded view of the plasma FSS.

FIG. 4C shows a material stackup of the Plasma-shell FSS, where two outer patterned conductive layers 404, 405 are laminated onto an array of Plasma-shells 406 to form composite material 407.

Figure 5:
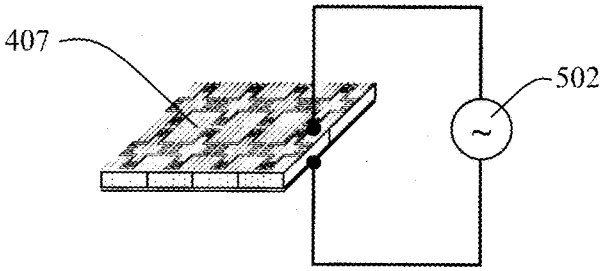
FIG. 5 is an assembled view of the plasma FSS connected to a high voltage source.

As shown in FIG. 5, the composite material shown in FIG. 4C as 407 can be driven with a high-voltage AC power source 502, nominally at frequency of about 1 megahertz (MHz). The high voltage across the Plasma-shell array creates a volume of plasma inside the shells. The plasma can directly interact with propagating EM energy through the outer conductive layers that are effectively transparent to X-band energy.

Figure 6:
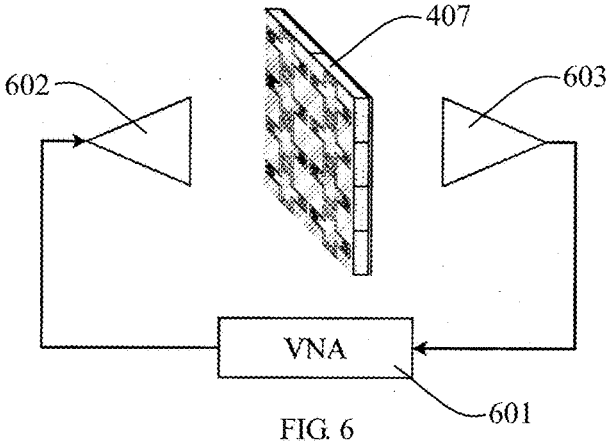
FIG. 6 is a Plasma-shell FSS test setup.

The frequency response of the Plasma-shell FSS is measured with the test setup in FIG. 6 that shows a vector network analyzer (VNA) 601 that measures FSS scatter (S)-parameters with different plasma states and antenna 602, 603 polarizations on the composite shell 501.

The Plasma-shells are shown as cubes or cuboids with all flat sides. However, other volumetric shapes may be used such as spheres, discs, and domes. The cross-sectional shapes of the Plasma-shell may be square, rectangular, circular, elliptical, triangular, and so forth. Various geometric shapes of gas-filled Plasma-shells including the manufacture of Plasma-shells are disclosed in U.S. Pat. No. 8,368,303 (Wedding et al.), U.S. Pat. No. 8,299,696 (Wedding et al.), U.S. Pat. No. 8,106,586 (Wedding et al.), and U.S. Pat. No. 7,978,154 (Strbik, III et al.), and U.S. Design Pat. D670,238 (Wedding et al.), all incorporated herein by reference.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A device composed of at least one or more gas encapsulating structures comprising a plasma-shell sandwiched between two or more patterned conductive sheets with said gas encapsulating structure electrically connected to the sheets such that a voltage potential across the two sheets will form a continuous volume of plasma within each gas encapsulating structure.

2. The invention of claim 1 wherein the plasma-shell is used as a controllable impedance elements.

3. A device composed of at least one or more gas encapsulating structures mounted to one or more patterned conductive sheets with said gas encapsulating structure electrically connected to the sheets such that incident energy induces a sufficient E-field within the gas encapsulating structures to ionize at least a portion of the gas to plasma.

4. The invention of claim 3 wherein the gas encapsulating structures are used as controllable impedance elements.

* * * * *